US008789697B1

(12) United States Patent
Severson, Jr.

(10) Patent No.: US 8,789,697 B1
(45) Date of Patent: Jul. 29, 2014

(54) PROTECTIVE DECORATIVE FLOWER RETENTION DEVICE

(71) Applicant: Howard Severson, Jr., San Leandro, CA (US)

(72) Inventor: Howard Severson, Jr., San Leandro, CA (US)

( * ) Notice: Subject to any disclaimer, the term of this patent is extended or adjusted under 35 U.S.C. 154(b) by 0 days.

(21) Appl. No.: 13/797,852

(22) Filed: Mar. 12, 2013

(51) Int. Cl.
*A47G 7/00* (2006.01)

(52) U.S. Cl.
USPC ..... 206/423; 47/41.11

(58) Field of Classification Search
USPC ..... 206/423, 426, 19; 47/41.01, 41.11, 47/41.12, 41.13, 41.15
See application file for complete search history.

(56) References Cited

U.S. PATENT DOCUMENTS

| | | | | |
|---|---|---|---|---|
| 1,963,804 | A * | 6/1934 | Powell | 47/41.1 |
| 2,010,246 | A * | 8/1935 | Slawson | 47/41.01 |
| 2,115,309 | A * | 4/1938 | Koch | 220/665 |
| 7,904,998 | B2 * | 3/2011 | Motz et al. | 27/10 |

* cited by examiner

*Primary Examiner* — Jacob K Ackun

(57) ABSTRACT

A cemetery flower holder that has a decorative cover that can possess convex and or acclivity shaped features to shield water and other undesirables away from the monument. Connecting to this cover is a tubular structure that can feature angularly and or radially expanding elastic tabs and or a foam structure. These are used to help retain the cemetery flower holder to the cemetery monument and or vase. Contained within the tubular structure are one or more flower retention devices, these connect to and extend through the decorative cover.

6 Claims, 15 Drawing Sheets

PROTECTIVE DECORATIVE FLOWER RETENTION DEVICE

FIELD OF THE INVENTION

The present invention relates to a cemetery flower display device and, more particularly, to a cemetery flower display device that provides protection and decoration to the monument.

BACKGROUND OF THE INVENTION

As with many good ideas, the embodiments revealed in this document were inspired by loss and crafted by searching for new and better ways to deal with this loss and the challenges it presented. In 1995 my Father passed away and I was faced with a set of problems that were new to me, these involving his grave care. Until that point I had not given any thought to the goings on in the cemetery environment or the after care of a loved one. One thing I did know is that I wanted his gravesite to express the fact that he was loved and missed by his family and friends and for it to also display a bit of his unique individuality. My vision was one of a peaceful place with ample floral decorations to symbolize resurrection and rebirth, displayed in an aesthetically pleasing manor. The first problem I encountered was that there were very limited options available in the market place. None of which allowed me to accomplish my goal in a way that added to the aesthetic presentation of the floral display I wanted for my Father's grave. I walked our cemetery and found that I was not alone in this quest, viewing many feeble attempts along the way. It seemed that most folks made due by using a green or white Styrene foam product that is sold in craft stores, this in an effort to secure their floral displays to their loved ones grave. My attempts at creating usable floral displays by employing this foam weren't any better. I quickly came to the conclusion that this foam was not the medium to use for this endeavor. It is neither good at retaining the floral display and is in no way aesthetic. It is time consuming to work with and requires the use of sharp cutting tools to shape and fit to the vase or monument. The use of these sharp tools can pose a risk of injury to the unskilled. It is unforgiving and if you didn't cut it just right or made it undersized you had to throw it away and start over. It is dirty, expelling many small gritty particles when it is shaped or cut. It is buoyant and could float right up out of the vase in heavy rains, dislodging the floral display. I found that the only way I could use this foam was to first glue it to the floral display and then to the monument. Simply put this was not the aesthetic I was looking for. I thought to myself, there had to be a better way and so I set out to create an answer.

Over time, I have been working diligently on various ideas that have at their core a clear set of goals that I wanted to achieve. My solution should be aesthetically pleasing. It should retain the floral display to the monument and not be dislodged by water or wind. It should be easy to use, quick to set up and install in the vase, vessel or monument. Sharp tools should not be need for its installation and use. It should make grave care simpler and give the gravesite a professional look. My thinking was that to be aesthetically pleasing, my creation would need to conceal the hole or bore opening in the vase, vessel or monument. My choice was to use a decorative surface or cover that could be slightly convex, keeping water and other undesirables out of and away from the vase, vessel or monument bore. The cover would allow for the attachment of a means or methods of retaining it to the vase, vessel or monument. This could be accomplished through the use of a method or methods of applying friction and or horizontally directed force against the inner walls of the bore of the cemetery vase, vessel, and or monument. A pulling force could also be applied to the underside of a gravestone type monument. I thought this connection could be achieved through the use of a tubular structure possessing one or more strategically placed springy beam tabs, one-way rollers and or other means of applying friction, downward pulling and other retention forces to the vessel bore. Alternatively, a closed cell foam material with an internal spreader could be used. In addition the cover could also have provisions for retaining artificial flowers. The flower retention device could add to the water resistance of the cover by protruding a distance above it and reducing the chance of rainwater entering the vessel through the flower retention device. A flexible seal could also be added to the retention device if needed. In covering the vase, vessel or monument bore another great advantage has been gained. The elimination of standing water provided by this cover shielding action denies disease caring insects a place to breed and thrive. In summer months, seldom does a week pass without a story appearing in the news media telling of an out break of the West Nile Virus. In 2009, a story was aired on the CBS evening news telling of how cemeteries in an effected area had asked that all floral arrangements be removed until the epidemic had subsided. Some cemeteries dispense a water retaining jell material that can have limited success if used properly. This jell does nothing for open vessels or for vessels that contain artificial floral decorations that still retain standing water. Just a few days are all that is required for these pests to gestate, unleashing swarms of disease caring vampires upon neighborhoods. These out breaks subsequently require the spraying of pesticides to quell and this spraying raises more health concerns in the affected community. Just a quick walk through any cemetery and you will soon realize that there are uncounted swimming pool volumes of stagnate water contained in the many uncovered flower vessels that populate the cemetery grounds. As well as promoting disease, in colder climates this standing water can freeze and expand, causing significant damage to vases and monuments. Ground vessel installations present another hazard. People attending funerals or walking in the graveyard have a tendency of tripping or turning ankles when stepping upon the edge of the open holes that these ground installations present. These ground openings can also eventually become unsightly when a grave goes unattended for a period of time, this allowing a place for un-mowed grasses and weeds to flourish. Another problem common to these open holes is that wind blown refuse tends to accumulate in them. By using my creation and covering the vase, vessel or monument bore these and various other problems can be averted.

Yes, I believe I have met or exceeded my goals. My design can be customized to work with the many and various styles of vases and or monuments found in the cemetery environment. Its flower retention methods are superior. The cover portion of my design gives the vase and or monument a neat, finished and a well kept, professional appearance and also the design provides many levels of safety to the cemetery environment. So say goodbye to the green foam and all other options as they have met their match.

There are several patents that have been granted for devices that try to deal with retaining silk flowers to a gravesite. None of these prior art devices combine the features and performance that my device offers.

One device is the Hugstem #7059082. This device uses a conical plastic structure that contains a series of foam pads at its center to retain the floral display. It relies on a series of foam rings to retain the device to the monument. Another device is Silk Flower Holder #7310909. It was created for a company that sells silk flower arrangements and is proprietary to their product. To my knowledge, of all the granted patents, though inferior, these two examples of prior art come the closest in design and intent to my device. The other patents that fall in the same class and category do not.

My device is superior in design to all others in many ways. It offers features and methods that make it unique and innovative. Unlike Silk Flower Holder #7310909, my device will be easy to use, reusable and can be purchased without being connected to a pre packaged flower arrangement. This enables the installer to create their own personalized and individualized flower display. Unlike Hugstem #7059082, my device does not rely on foam strips to retain the flower, as these can allow the flower to tip or wiggle out in the wind. Nor does it use unsupported foam rings to retain the device to the vase or monument. Over time these unsupported rings can take the shape of the monument and no longer properly retain the device to the monument or vase. Neither of these designs adds the component of being decorative as mine does. Yes, Hugstem has provisions for added decorations, but when installed in the monument or vase you are still presented with a black hole populated by slotted foam sheets. Thats not decorative in my opinion and doesn't compliment the presentation. Neither design adds the component of intentionally shielding the bore of the cemetery monument and or vase from water incursion as my design does. My device possesses both flower and monument retention methods and features that are more positive and are better in design then both of these. Shortcomings of the other designs that fall in this category are that they are either impractical or not saleable. One design even using elastic cords to secure the flower to the monument. I just can't see that selling in the real world. The remainder use methods and features that don't correlate with the methods and features used by my design.

SUMMARY OF THE INVENTION

In accordance with the present invention, there is provided a cemetery flower holder that has a decorative cover that can possess convex and or acclivity shaped features to shield water and other undesirables away from the monument. Connecting to this cover is a tubular structure that can feature angularly and or radially expanding elastic tabs and or a foam structure. These are used to help retain the cemetery flower holder to the cemetery monument and or vase. Contained within the tubular structure are one or more flower retention devices, these connect to and extend through the decorative cover.

It would be advantageous to provide a decorative flower holder for the cemetery environment.

It would also be advantageous to provide a flower holder that shields the vase and or monument from stagnant and standing water.

It would also be advantageous to provide a flower holder that shields the monument from an accumulation of dirt and refuse.

It would also be advantageous to provide a flower holder that protects the monument from freeze damage.

It would also be advantageous to provide a flower holder that protects the cemetery and it's neighbors from disease.

It would also be advantageous to provide a flower holder that protects the cemetery visitor from injury.

It would also be advantageous to provide a flower holder that is quick to set up and easy to use.

It would also be advantageous to provide a flower holder that can be customizable and individualizable.

It would also be advantageous to provide a flower holder that is secure and stays in place.

It would further be advantageous to provide a flower holder that installs without the use of sharp tools.

BRIEF DESCRIPTION OF THE DRAWINGS

A complete understanding of the present invention may be obtained by reference to the accompanying drawings, when considered in conjunction with the subsequent, detailed description, in which.

Figure 1:
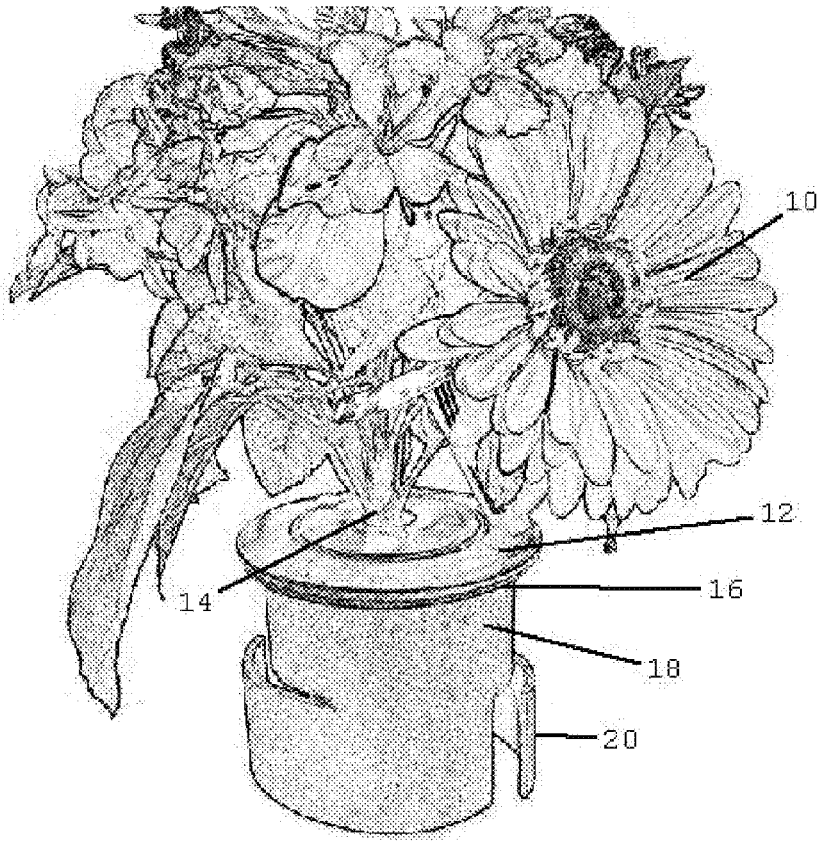
FIG. 1 is a front elevation view of an embodiment possessing radailly horizontal tabs and ready to be used.

| DRAWINGS REFERENCE NUMERALS | |
|---|---|
| 10 Silk Flower | 12 Cover |
| 14 Holes | 16 Undercut |
| 18 Tubular Structure | 20 Tabs |
| 22 Flower Retention Mechanism | 24 Threaded Force Creation Device |
| 26 Elastic Extensions | 28 Slope |
| 30 Extension, | 32 Access Hole |
| 34 Foam Material | 36 Elastic Helper |
| 38 Retainer | 40 Spring Spreader |
| 42 Spreader Opening | 44 Attachment Feature |

For purposes of clarity and brevity, like elements and components will bear the same designations and numbering throughout the Figures.

DESCRIPTION OF THE PREFERRED EMBODIMENT

Figure 7:
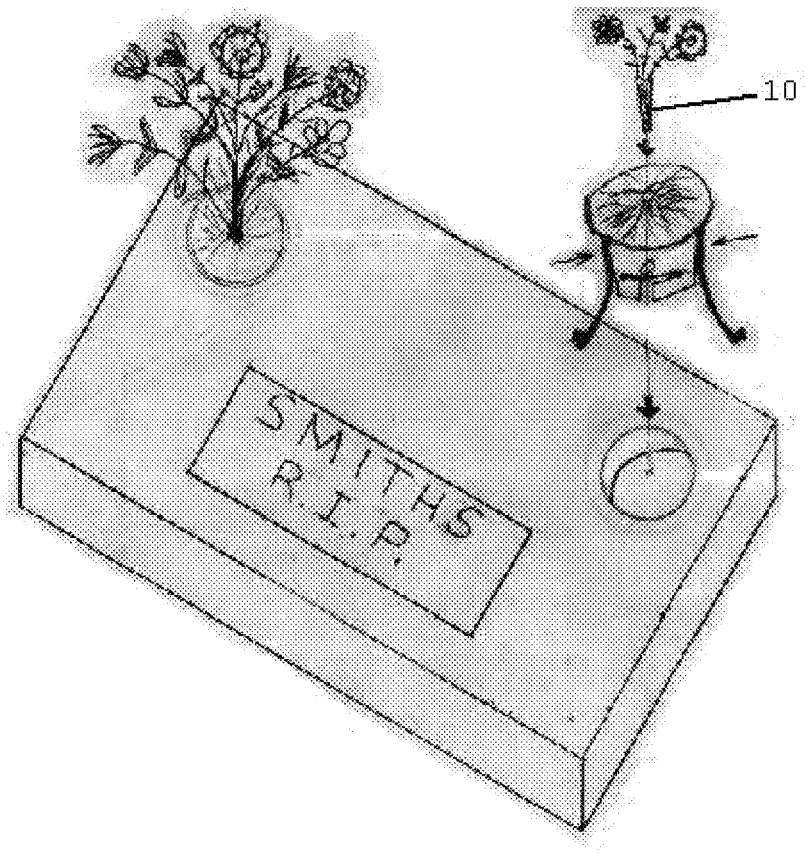
FIG. 7 is a top perspective view of an embodiment being assembled and in use.

The drawings and descriptions that follow details a tubular structured decoratively covered flower retention embodiment that shields the cemetery vase and or monument from unwanted water retention and other unwanted circumstances. FIG. 7 shows a view of the embodiments, as they would appear in use. The embodiment to the left is fully installed.

The embodiment to the right simulates the silk flower being inserted into to the embodiment and then being installed into the cemetery ground marker.

Figure 3:
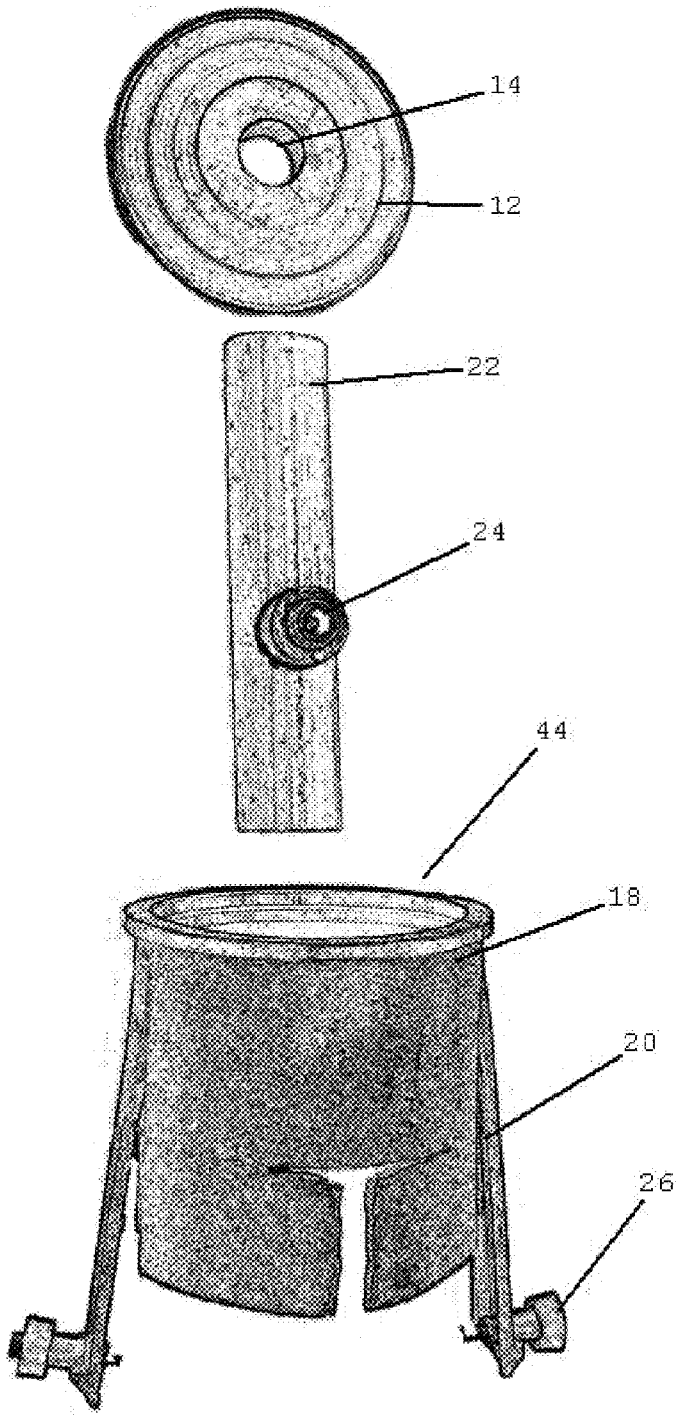
FIG. 3 is an assembly view view of an embodiment with vertical and radailly horizontal tabs.
Figure 4:
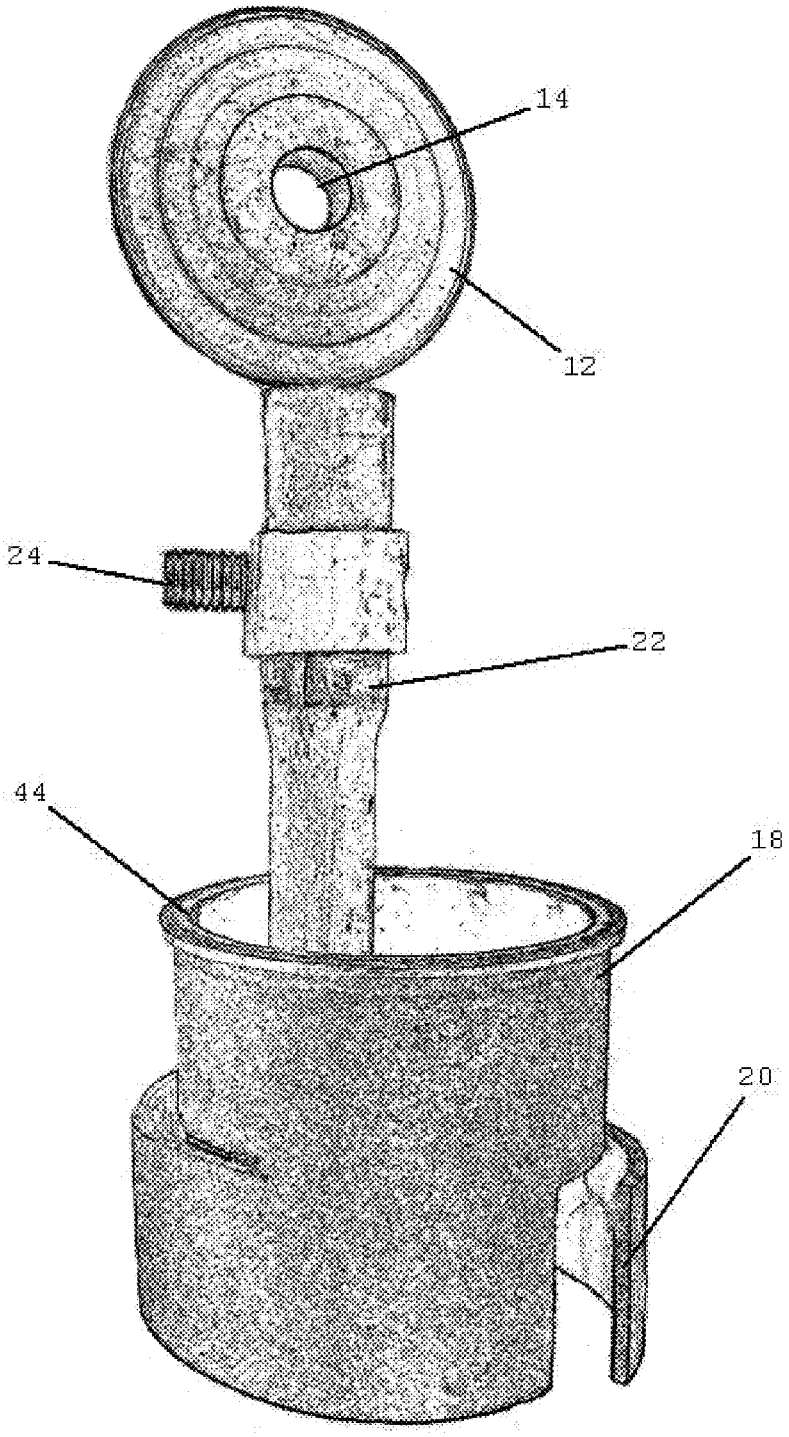
FIG. 4 is an assembly view view of a radailly horizontal tabbed embodiment.
Figure 5:
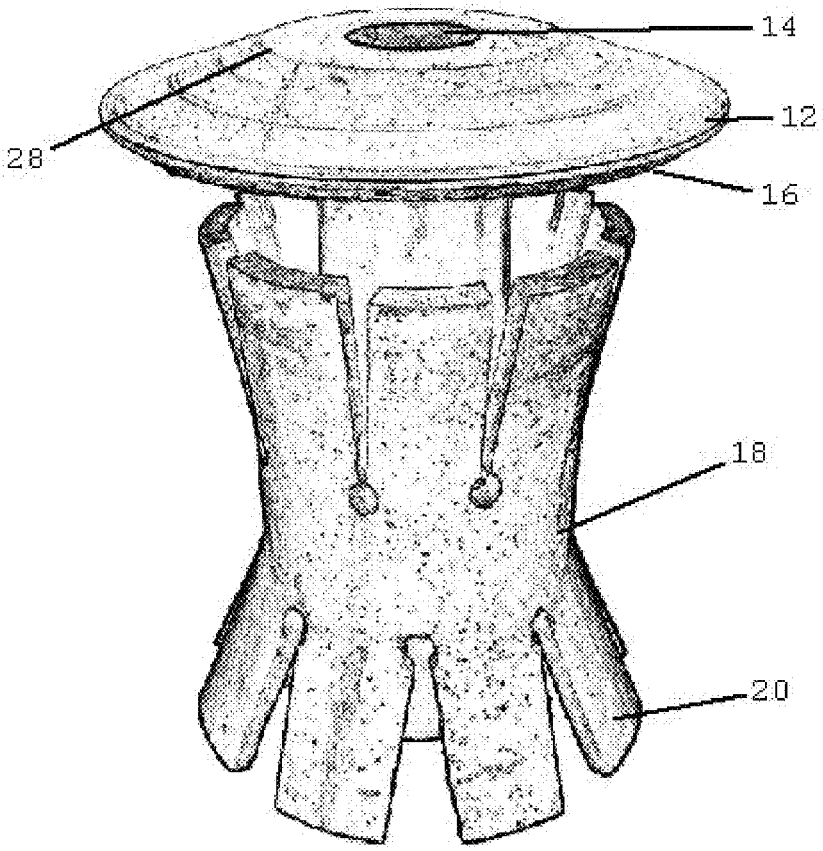
FIG. 5 is a front perspective view of a vertical tabbed form of the embodiment.
Figure 10:
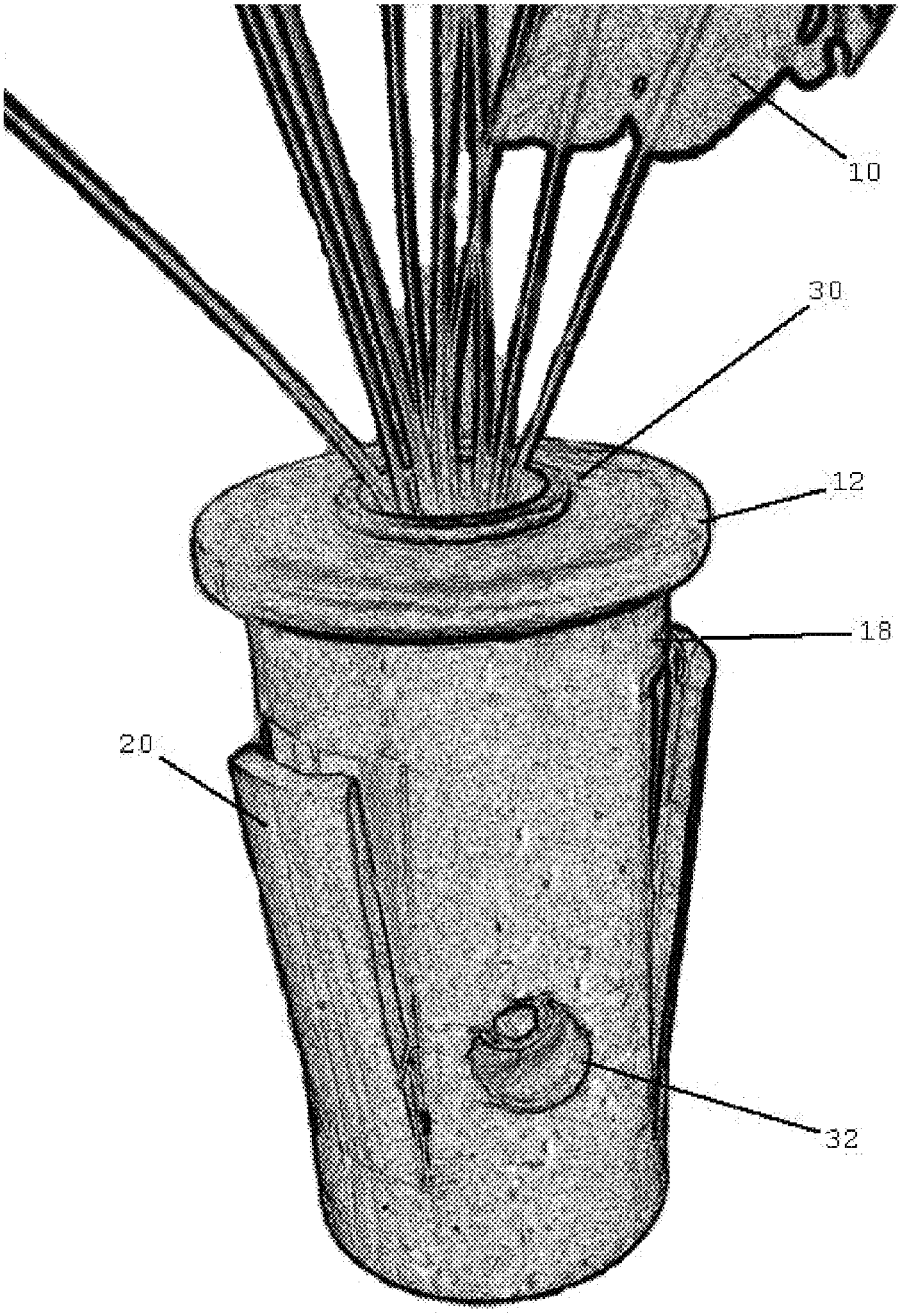
FIG. 10 is a front perspective view of a vertically tabbed embodiment with a silk flower installed.

Starting from the top of the drawings and working down, we will first describe the cover 12 portion of these embodiments. FIGS. 3,4,5,6,8 and 10 show various views of cover 12. Cover 12 serves several important functions, these are as follows. Cover 12 can be made larger in diameter or span then the lumen and or bore of the vase and or monument. Being larger, cover 12 can shield the cemetery vase and or monument from water incursion. Standing water can provide a breeding ground for disease caring insects. Standing water can freeze, damaging the vase or monument. Cover 12 can prevent injury by covering ground openings. Cover 12 can restrict sunlight and stop the growth of weeds, algae and other undesirables. Cover 12 can prevent leaves, clippings and other debris found in the cemetery environment from collecting in the cemetery vase or monument. Cover 12 can help to support the floral arrangement if one is present. Cover 12 can put fourth a clean professional appearance. Cover 12 can have added features to facilitate the display of additional decorations such as flags and balloons. Cover 12 can, for example, be constructed of a plastic material (PVC). Cover 12 can be machine cut, molded or created using other means. If molded, cover 12 can be incorporated onto and be part of tubular structure 18. If not incorporated, the bottom surface of cover 12 can have attachment features 44. These to include but not limited to, gluing surfaces, grooves and or snap together means. These attachment features 44 will be provided as needed to allow cover 12 to be connected to tubular structure 18. Throughout many of these views, cover 12 is shown to have a sloping top surface. This feature has been somewhat exaggerated in these views to express that there can be a slope 28 to the top of the cover 12. Slope 28 is used to channel water away from the bore of the cemetery vase and or monument. Slope 28 could center in the middle of cover 12, rising like a mountain. Slope 28 could be tilted giving an edge, side or corner of cover 12 a higher elevation then the rest. A hole or holes 14 can be located in cover 12. Holes 14 can have flower retention mechanism 22 connected to them. Though shown as a round form in these drawings, please be aware that cover 12 can be formed into any shape, geometrically describable or not. The only rule is that cover 12 should shield the lumen and or bore of the cemetery vase or monument. Cover 12 can have undercut 16 created to improve fit and assist sealing in certain applications. Cover 12 can be decorated in any method or manor acceptable. This to include but not limited to: painting, plating, etching, engraving, faceting, coloring, patterning and bejeweling. Cover 12 could have added sealing components added or incorporated into it. Cover 12 could have gripping features incorporated into it to engage with the cemetery vase or monument. Cover 12 could employ magnetic, adhesive and or other means or methods to assist with its connection to the vase and or monument Next we turn our attention to the Flower retention mechanism 22. FIG. 3 and FIG. 4 show various views of flower retention mechanism 22. Flower retention mechanism 22 can be employed to grip, retain and vertically align the stem and or stems of silk flowers 10. Flower retention mechanism 22 will allow the installer to quickly arrange and or exchange and display silk flowers 10. Flower retention mechanism 22 can connect and secure silk flower arrangements to the embodiments. Flower retention mechanism 22 could be constructed and or created of a plastic material (PVC) for example. Flower retention mechanism 22 can contain within itself a means or method for retaining the stem or stems of silk flowers 10. In this example a threaded force creating device 24 is used to apply pressure against the stem and or stems of silk flowers 10. The force created by threaded force creating device 24 retain silk flowers 10 to the flower retention mechanism 22. Other means of creating stem-gripping forces are listed, but not shown. They include adhesives, spring loaded wedges, spring loaded palls, piercing methods, radially located springy leaves, folded flat springs, collets, rolled foam and or any other form of one way trapping and or gripping devices. The flower retention mechanism 22 can have features that allow it to be attached and or connected to cover 12 and or tubular structure 18. This connection can be made during manufacture and or through the use of glue, snap together construction or other means. As shown in FIG. 10, flower retention mechanism 22 can have extension 30 that can extend through and above cover 12. Extension 30 can be added to improve water resistance.

Figure 6:
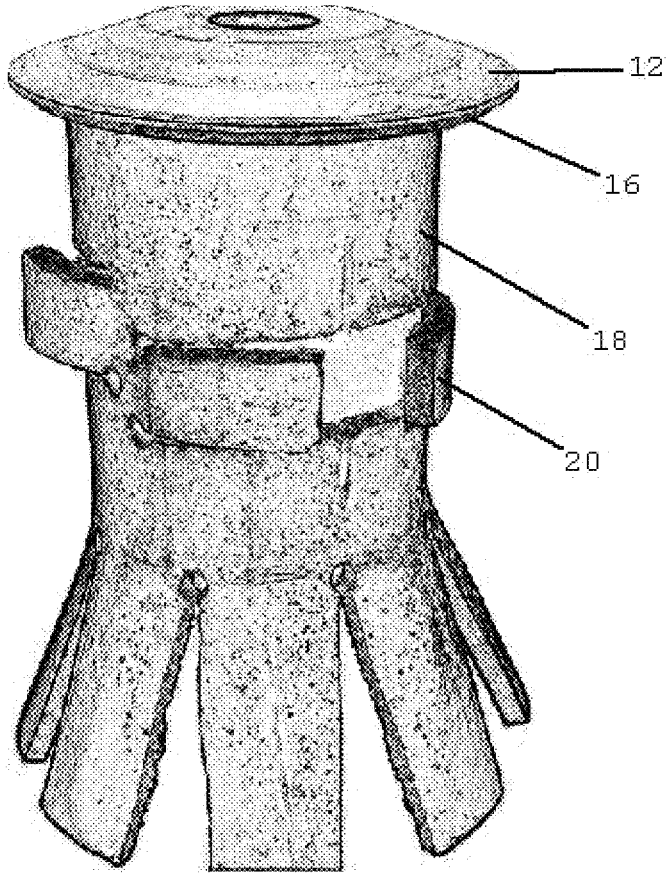
FIG. 6 is a front perspective view of a form of the embodiment displaying both tab styles.
Figure 8:
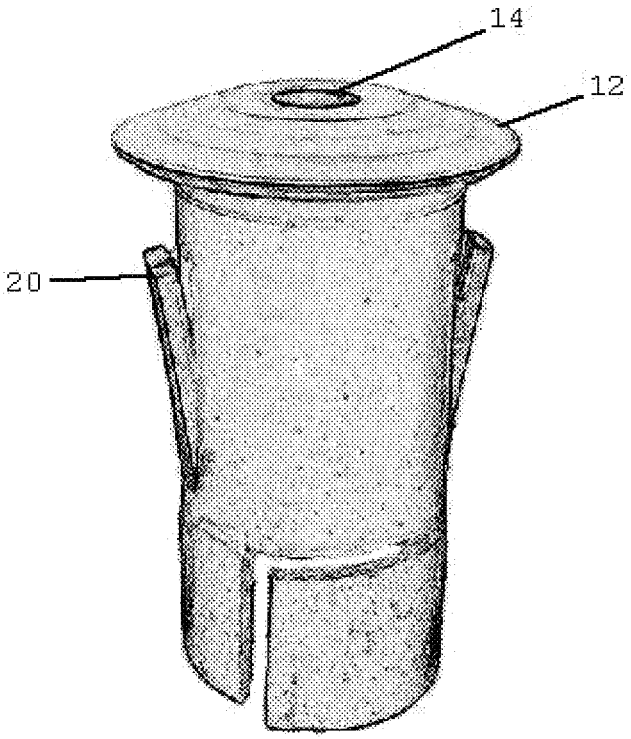
FIG. 8 is a front perspective view of an embodiment with both tab styles displayed.

Continuing down the drawings we turn our attention to tubular structure 18. FIGS. 1,2,3,4,5,6,8,9 and 10 show various views of tubular structure 18. Tubular structure 18 can be constructed of a plastic material such as ABS or PVC for example. Tubular structure 18 can be manufactured by molding, machining or other methods. If molded, cover 12 can be incorporated onto tubular structure 18 when manufactured. If assembled, FIGS. 3 and 4 show attachment feature 44 can be present. Attachment feature 44 can be added as a connection point for attaching and securing cover 12 to tubular structure 18. Attachment feature 44 can be a surface or area for adhesive. Attachment feature 44 could also facilitate a snap together or other construction methods. Tubular structure 18 can be endowed with one or more protruding spring-loaded tab and or tabs 20. FIGS. 1 and 4 show that tabs 20 can be placed radially aligned in relationship to tubular structure 18. FIGS. 2,5,9 and 10 show that Tabs 20 can be placed vertically aligned in relationship to tubular structure 18. FIGS. 3,6 and 8 show that tabs 20 can be set angularly and radially aligned in relationship to tubular structure 18. Tabs 20 can be combined in any combination in relationship to tubular structure 18. Tabs 20 can be added, formed from, constructed of and or attached to tubular structure 18. Tabs 20 will be of sufficient length and or angle to extend a distance from tubular structure 18. This distance and or angle will be such that tabs 20 will encompass a diameter and or spread greater then the bore or inner shape of the cemetery flower vase, monument or cup. Tabs 20 width, thickness and count can be adjusted as needed to meet design requirements. Tabs 20 can be curved in design to place as much surface area against the bore. Tabs 20 tips can be bent outward to better engage the bore of the vase and or monument. Tabs 20 will serve to locate, retain and center tubular structure 18 in the cemetery vase and or monument. When tubular structure 18 is pushed into the cemetery vase and or monument, tabs 20 contract. This forced contraction (a resistive spring force is created) causes tabs 20 to exert a spring loaded force horizontally and or angularly against the walls of the bore of the vase and or monument. This force secures tubular structure 18 to the vase and or monument. As seen in FIGS. 3 and 6 tabs 20 can also extend below the cemetery monument and apply a downwardly pulling force directed against the bottom of the monument. FIG. 3 also shows that the tips of tabs 20 can have added features to help with retention. These features can include but are not limited to elastic extensions 26, non-slip coatings, gripping teeth, one-way roller devices, serrations and other lock in features. FIG. 10 shows that tubular structure 18 can have an access hole 32. Access hole 32 is added to allow access to flower retention mechanism 22. Cemetery vases and monuments can have various makers and differ greatly in design. Tubular structure 18 can be customized to install and fit all designs.

Figure 2:
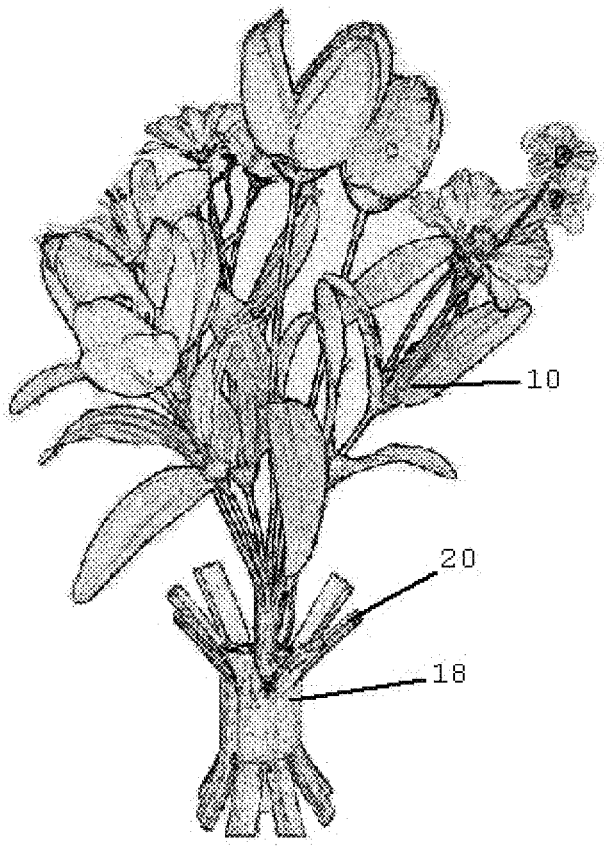
FIG. 2 is a front perspective view of an embodiment possessing vertical tabs and ready to be used.
Figure 9:
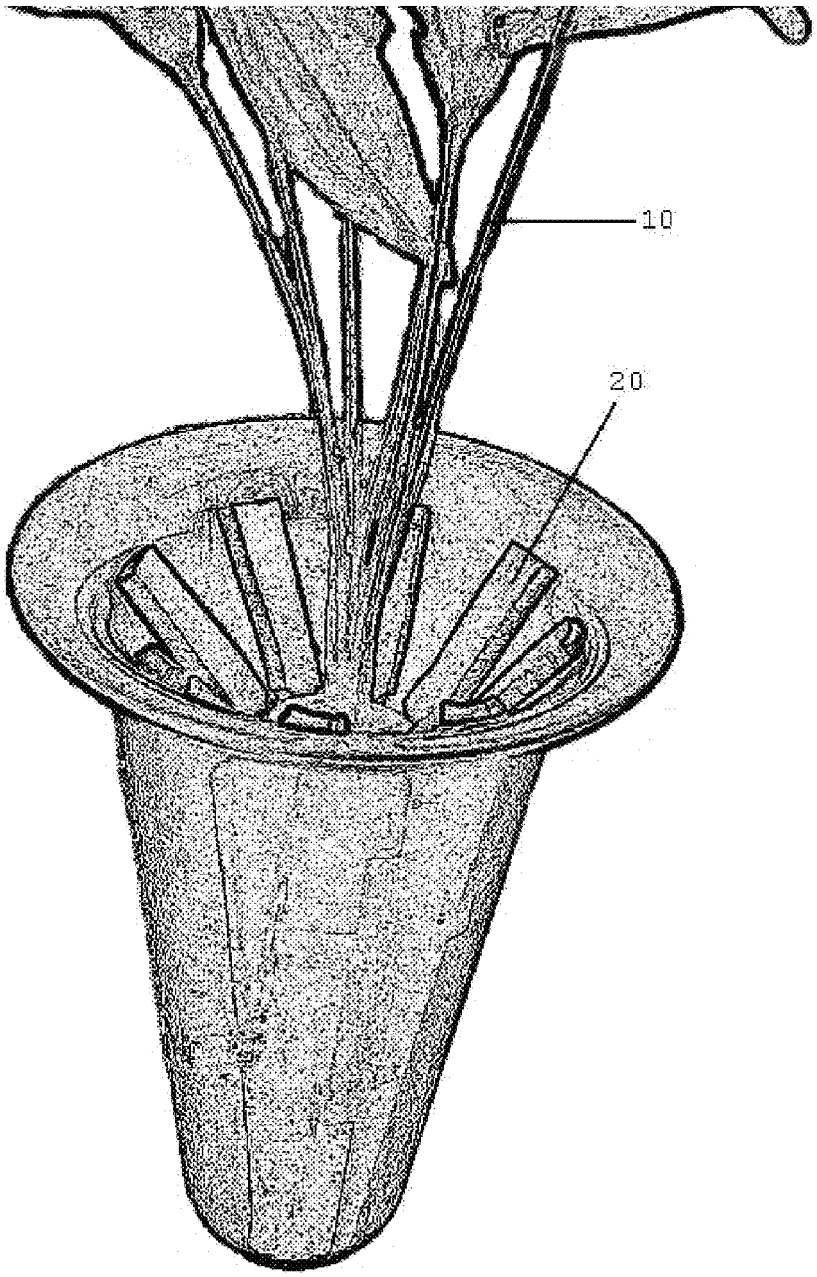
FIG. 9 is a front perspective view of an embodiment installed in a cemetery vase.

Tubular structure 18 can accommodate any diameter and or depth and be used in tapered, straight or other shaped bores. If design requires, spring-loaded plungers or other means could augment or replace some or all tabs 20. If needed, tubular structure 18 can have weight or mass added to it to help retain it to the cemetery vase and or monument. In severe conditions, tubular structure 18 could have a lanyard that could secure it to the cemetery vase and or monument. FIG. 2 and FIG. 9 are shown without cover 12 to assist with viewing.

Figure 11:
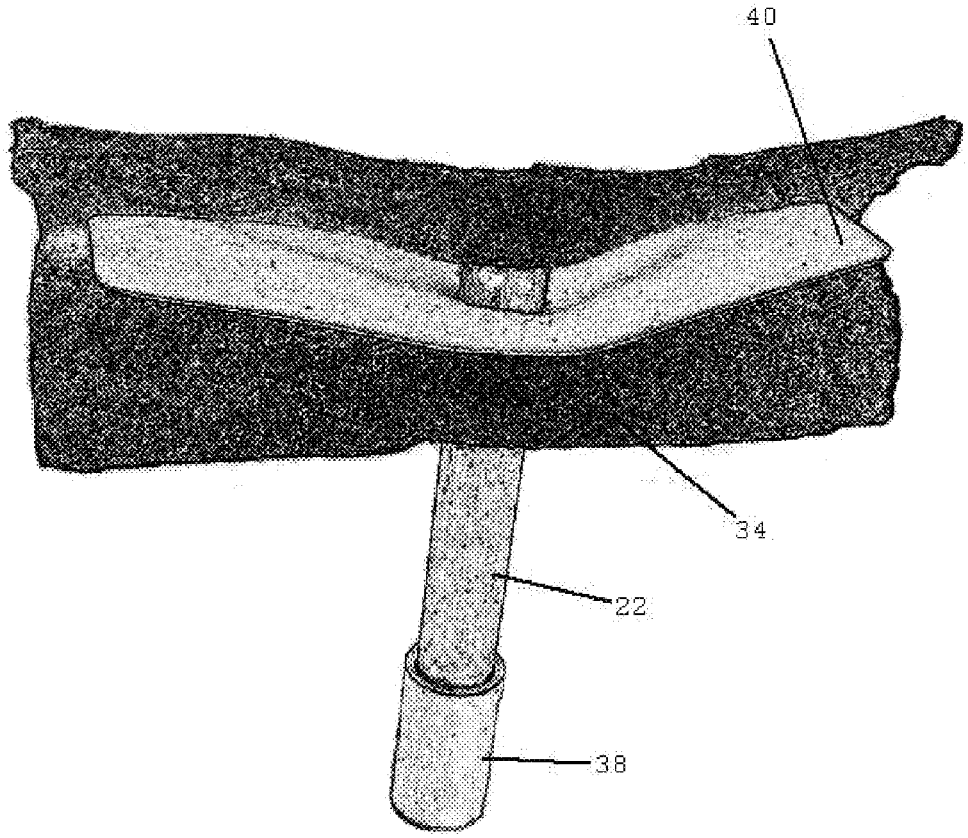
FIG. 11 is an assembly view view of a foam and spreader alternative embodiment.
Figure 12:
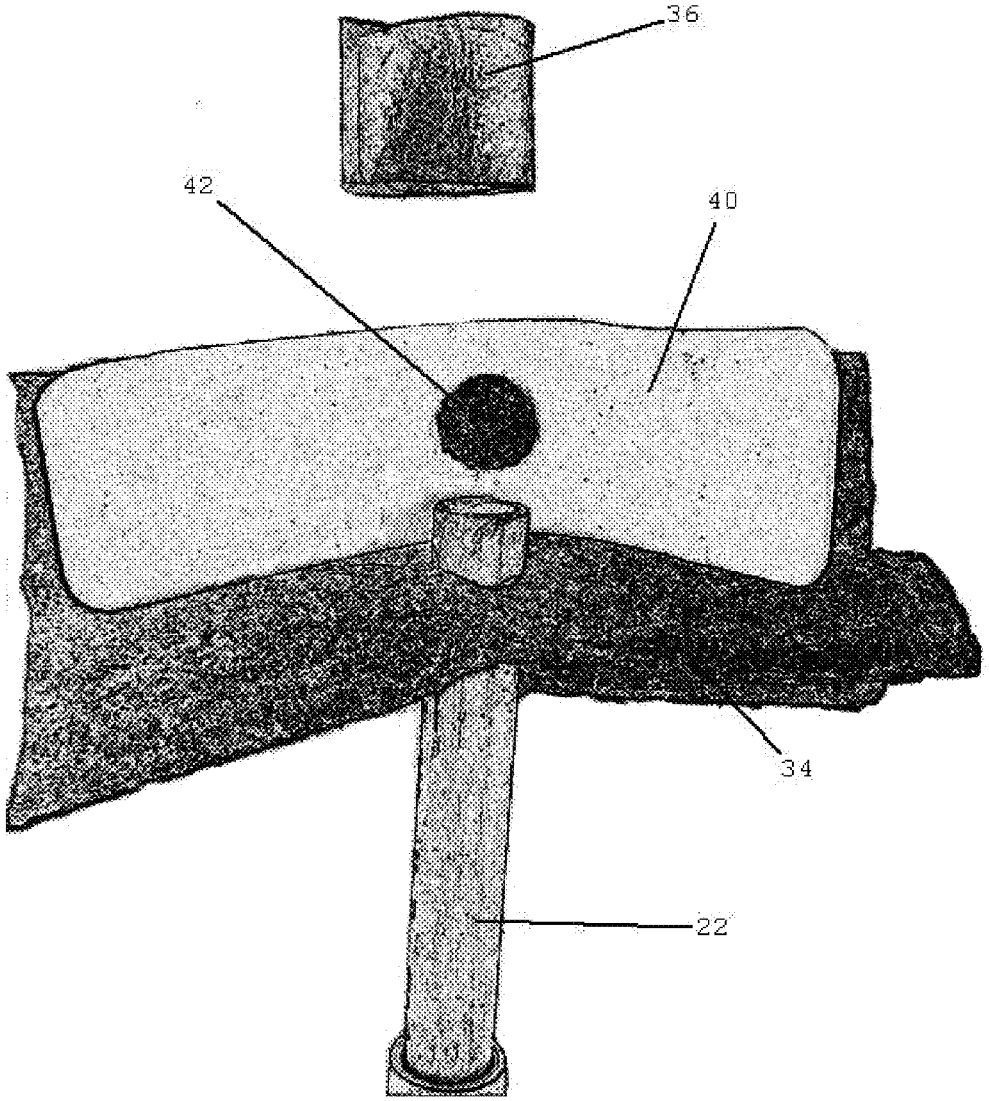
FIG. 12 is an assembly view view of a foam retained alternative embodiment.
Figure 13:
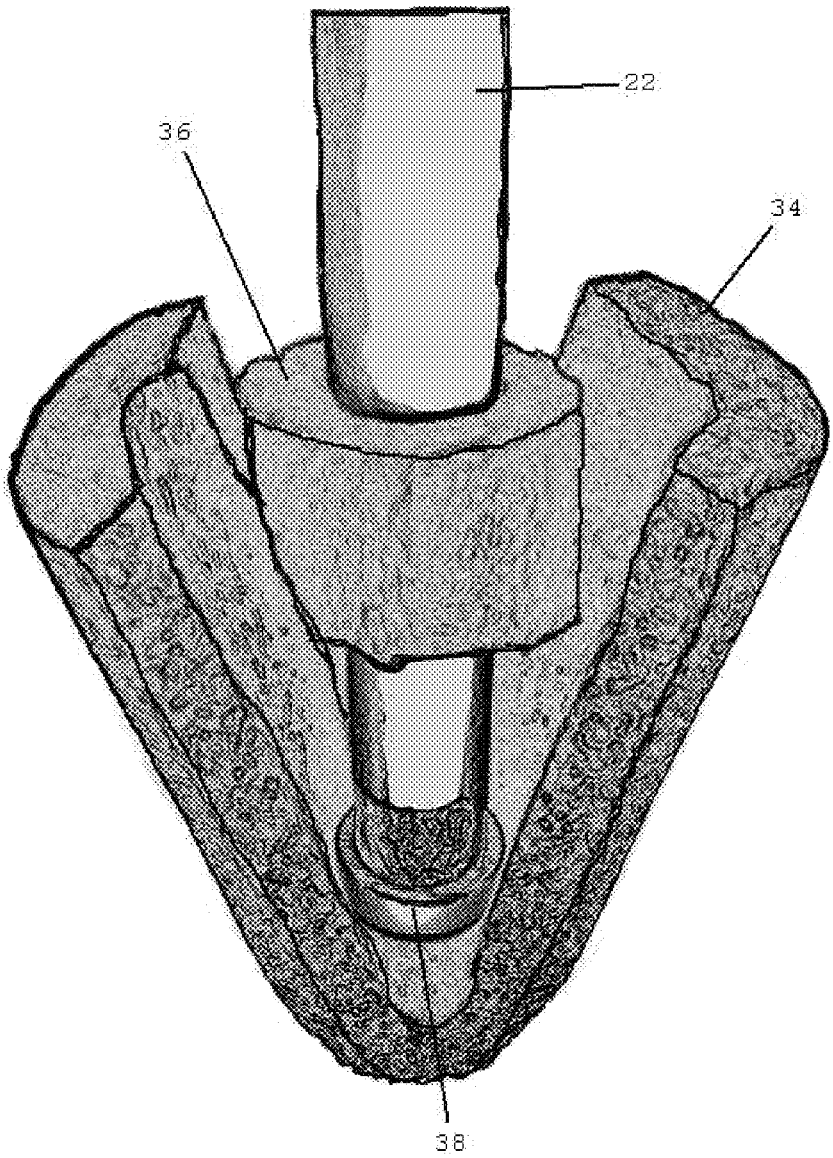
FIG. 13 is an assembly view view of an assembled foam alternative embodiment.
Figure 14:
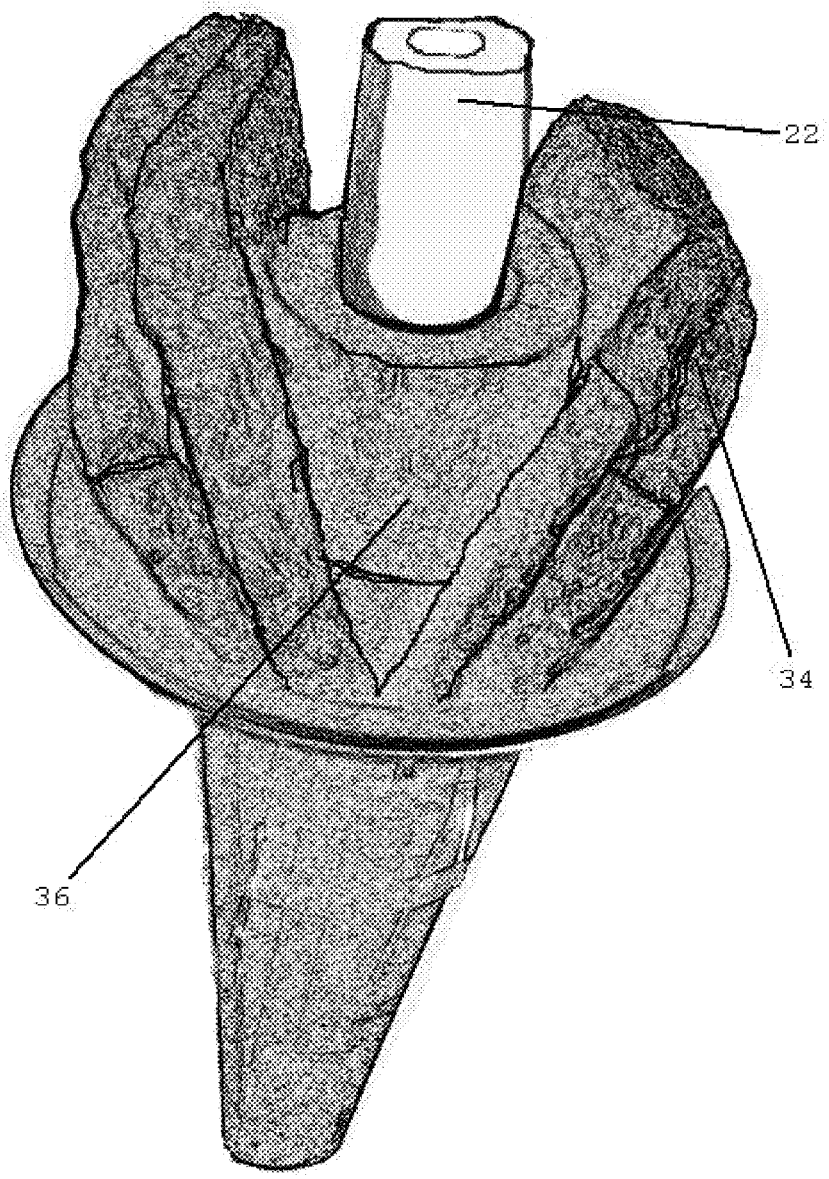
FIG. 14 is a front perspective view of an alternative embodiment being installed into a cemetery vase.
Figure 15:
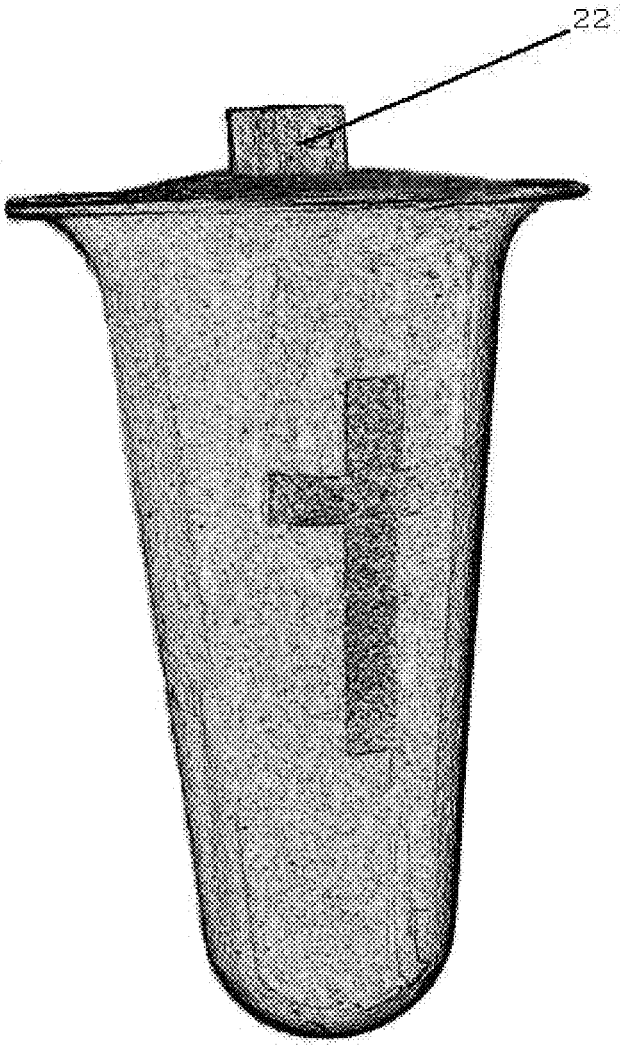
FIG. 15 is a front perspective view of an alternative foam embodiment fully installed in a cemetery vase.

FIGS. 11,12,13,14, and 15 depicts the embodiment of an alternative retention method. This method uses a folded strip, strips and or sheet of closed cell foam material 34. Foam material 34 will retain and secure the embodiment to the vase and or monument. FIG. 11 shows that foam material 34 can have a spring spreader 40 added to it. Spring spreader 40 can be sandwiched within foam material 34. Spring spreader 40 can alternatively be located and or attached to the surface of foam material 34. Spring spreader 40 is intended to keep foam material 34 expanding and pushing outwards. Spring spreader 40 prevents foam material 34 from relaxing over time and taking the shape of the bore of the monument and or vase. Relaxed foam material 34 can allow wind and water to dislodge the embodiment. Spring spreader 40 can be constructed of plastic and or other springy materials. Flower retention mechanism 22 passes through spring spreader 40 and foam material 34. Connected to flower retention mechanism 22 is foam and spring retainer 38. Retainer 38 keeps foam material 34 and spring spreader 40 attached to and located on flower retention mechanism 22. Retainer 38 can be made of plastic or other material. FIG. 12 shows a better view of flower retention mechanism 22 passing through foam material 34. Also shown is spreader opening 42 that allows flower retention mechanism 22 to pass through spring spreader 40. An additional elastic helper 36 can be added to the assembly. Flower retention mechanism 22 also passes through elastic helper 36 and retains it. Elastic helper 36 is added to augment and or increase the outward force of foam material 34. FIG. 13 shows the embodiment being readied to be inserted into a cemetery vase or monument. Also shown in this view is the relationship between flower retention mechanism 22, elastic helper 36, foam material 34, and retainer 38. FIG. 14 shows the embodiment being inserted into a cemetery vase with all relationships shown. FIG. 15 shows the embodiment fully inserted into a cemetery vase. Be aware that, though not shown, the contact surface of foam material 34 can be treated with or have added to it a non-slip material. This will be added to increase retention properties of foam material 34 to the vase and or monument. Spring spreader 40 can be shaped or formed to fit any bore shape found in a cemetery vase and or monument. Spring spreader 40 can have features added and or created to increase its ability to apply pressure to the bore of the cemetery vase and or monument.

To use these embodiments a silk flower and or flowers and other decorations can be added. The embodiment is then simply placed into the cemetery vase and or monument bore and or opening. The embodiment is then push down into the bore. Depending on design, tabs 20 may need to be depressed and or foam material 34 folded to allow entry into the bore and or opening of the vase and or monument. Once fully inserted the embodiment is ready for use.

Reoccurring parts will appear in different and various views and follow through in these embodiments. For clarity, decorative cover 12 has been omitted from some views. Materials and procedures when described or specified are provided as examples only and will not serve to limit, constrain or addle these embodiments.

Manufacturing techniques, methods, tools, materials and procedures used to create these embodiments shall not be limited.

Since other modifications and changes varied to fit particular operating requirements and environments will be apparent to those skilled in the art, the embodiments are not considered limited to the example chosen for purposes of disclosure, and covers all changes and modifications which do not constitute departures from the true spirit and scope of these embodiments.

Having thus described these embodiments, what is desired to be protected by Letters Patent is presented in the subsequently appended claims.

What is claimed is:

1. A protective decorative flower retention device for preventing water incursion, restraining floral displays and adding decorative features to a gravesite, comprising:

a cover, for covering a cemetery vase or monument at the gravesite and shielding the vase or monument from water and dirt;

a hole, of at least one instance, for helping to support a floral arrangement, constructed to said cover;

an undercut, for improving fit and assisting in sealing the vase or monument, created to said cover;

a tubular structure, for accommodating any diameter, depth and shape of cemetery vase or monument, connected to said cover;

a tab, of at least one instance, for locating, retaining and centering said tubular structure, added, formed, constructed or attached to said tubular structure;

a flower retention mechanism, for gripping, retaining and vertically aligning a stem or stems of silk flowers, connected to said cover or said tubular structure;

a threaded force creating apparatus, for applying pressure against the stem or stems of silk flowers, connected to said flower retention mechanism;

an elastic extension, of at least one instance, for helping with retention, removable connected to said tab;

a slope, for channeling water away from the bore of said cemetery vase or monument, constructed to said cover;

an extension, for improving the water resistance of said cemetery vase or monument, added to said flower retention mechanism; and an access hole, for allowing access to said flower retention mechanism, added to said tubular structure.

2. A protective decorative flower retention device for preventing water incursion, restraining floral displays and adding decorative features to a gravesite, comprising:

a cover, for covering a cemetery vase or monument at the gravesite and shielding the vase or monument from water and dirt;

a hole, of at least one instance, for helping to support a floral arrangement, constructed to said cover;

a slope, for channeling water away from the bore of said cemetery vase or monument, constructed to said cover;

an undercut, for allowing said cover to fit monuments with sunken surrounds and assist in sealing the vase or monument, created to said cover;

a flower retention mechanism, for gripping, retaining, and vertically aligning a stem or stems of silk flowers, connected to said cover or said tubular structure;

a threaded force creating apparatus, for applying pressure against the stem or stems of the silk flowers, connected to said flower retention mechanism;

an extension, that extends through and above said cover, for improving the water resistance of said cemetery vase or monument, added to said flower retention mechanism;

a foam material, for retaining and securing the device to said cemetery vase or monument, secured to said flower retention mechanism;

a spring spreader, for keeping said foam material expanding and pushing outwards, preventing said foam material from relaxing and taking the shape of the bore of said cemetery vase or monument, connected to said foam material;

a spreader opening, for said flower retention mechanism to pass through said spring spreader and said foam material, retained to said flower retention mechanism;

a retainer, for keeping said foam material and said spring spreader attached and located on said flower retention mechanism, connected to said flower retention mechanism; and an elastic helper, for augmenting or increasing the outward force of said foam material, attached to said flower retention mechanism.

3. A protective decorative flower retention device for preventing water incursion, restraining floral displays and adding decorative features to a gravesite, comprising:

a cover, having a top surface, a bottom surface, said cover encompassing a span larger than the bore of a vase;

a hole, of one or more instance, disposed there through said top surface and said bottom surface of said cover;

a flower retention mechanism, having an inner surface and an outer surface, said flower retention mechanism connecting to said hole on said bottom surface of said cover, said inner surface of said flower retention mechanism fabricated to be compatible with a silk flower stem of one or more instance;

a tubular structure, having an exterior, an interior and a pair of ends, one end of said tubular structure connecting to said bottom surface of said cover, said exterior of said tubular structure being congruent with the bore of said vase, said tubular structure containing within it, said flower retention mechanism; and a spring loaded tab, of one or more instance, formed there onto said exterior of said tubular structure, said spring loaded tab set at a salient angle in relation to said exterior of said tubular structure, said tab and said tubular structure combined having an overall span greater then the bore shape of said vase.

4. The protective decorative flower retention device in accordance with claim 3, wherein said top surface of said cover, having a profile selected from the group consisting of sloped, curved and domed.

5. The protective decorative flower retention device in accordance with claim 3, wherein connecting methods are selected from the group consisting of molding, gluing, screwing, welding and press together.

6. The protective decorative flower retention device in accordance with claim 3, wherein said flower retention mechanism contains within itself a means for retaining and gripping said silk flower stem.

* * * * *